United States Patent [19]

Sutton

[11] Patent Number: 4,764,054

[45] Date of Patent: Aug. 16, 1988

[54] PILING-JACKET SYSTEM AND METHOD

[76] Inventor: John S. Sutton, 7460 Tidewater Dr., Norfolk, Va. 23505

[21] Appl. No.: 35,411

[22] Filed: Apr. 7, 1987

[51] Int. Cl.[4] ..... E02D 5/60

[52] U.S. Cl. ..... 405/216; 137/855; 249/105; 405/211

[58] Field of Search ..... 405/216; 249/48, 105; 137/855; 251/298, 299, 144

[56] References Cited

U.S. PATENT DOCUMENTS

| | | | |
|---|---|---|---|
| 950,858 | 3/1910 | Mahoney | 251/299 X |
| 1,360,986 | 11/1920 | Hoopes . | |
| 2,378,613 | 6/1945 | Young et al. | 137/855 |
| 3,132,382 | 5/1964 | Magester | 249/105 X |
| 3,338,058 | 8/1967 | Young . | |
| 3,364,941 | 1/1968 | Harder | 249/105 UX |
| 3,397,260 | 8/1968 | Lamberton | 405/216 X |
| 3,492,823 | 2/1970 | Lamberton | 405/233 |
| 3,690,110 | 9/1972 | Wiswell, Jr. | 405/216 |
| 3,708,146 | 1/1973 | Lamberton | 249/1 |
| 3,719,049 | 3/1973 | Shaw et al. | 405/216 |
| 3,788,047 | 1/1974 | Douthitt | 137/855 X |
| 3,934,422 | 1/1976 | Fredrickson et al. | 405/195 |
| 3,968,925 | 7/1976 | Johnston et al. | 137/855 X |
| 4,439,070 | 3/1984 | Dimmick | 405/216 |

*Primary Examiner*—Dennis L. Taylor

*Attorney, Agent, or Firm*—Griffin, Branigan, & Butler

[57] ABSTRACT

A piling-jacket system (10) and method involves a piling jacket (12) having a side, vertically-slit, open port arrangement (14) with an internal flap valve in the shape of a duct (48) attached to a cord (56) which extends externally of the piling jacket to positively force the duct flap valve closed. The piling jacket system includes a steel band (84) at the top of the piling jacket which clamps the piling jacket in a notch (86,88) cut in a piling (80) to be repaired with the piling-jacket system. When the piling jacket is thusly hung from the piling, the lower portion of the piling jacket, pulling down on the vertically-slit open port tends to close the open port. A portable, rigid, access tube (66) is placed through the vertically-slit open port to hold it open for the insertion of a grout-supply hose.

19 Claims, 3 Drawing Sheets

PILING-JACKET SYSTEM AND METHOD

BACKGROUND OF THE INVENTION

This invention relates generally to the art of forms for casting columns and particularly to the art of flexible forms for casting such columns about pilings.

For a number of years, both wooden and concrete pilings of the type for supporting bridges, docks, and the like in water have been repaired by placing flexible piling jackets about damaged area thereof, injecting a rigidifying liquid substance into a space between the piling jacket and the piling, and allowing the rigidifying agent to harden, thereby filling broken out or rotted areas of the piling and providing a surrounding supporting cylinder therefor. The rigidifying substance is normally a cement mixture made with any one of various fillers. In this application the rigidifying agent will be referred to as grout or concrete interchangeably, each including the other.

A difficulty which has been encountered with piling-jacket systems of the prior art is that many of them require leaving the top ends of the piling jackets open, as is shown in U.S. Pat. No. 3,708,146 to Lamberton. Such systems have the disadvantage that the top ends of the jackets must be above water or, if they are underwater, movement of water into and out of the top ends adversely affects settling and curing of the grout. Thus, it is an object of this invention to provide a piling-jacket system employing a piling jacket whose top end is not open, but rather is closed.

There have been a number of prior-art piling-jacket systems suggested in which top ends of piling jackets have been closed. Two such systems are described in U.S. Pat. No. 3,934,422 to Fredrickson et al. and U.S. Pat. No. 3,397,260 to Lamberton. Such systems often involve the extension of a grout-supply hose through a side port into the interior of the jacket for injecting grout therein. In such situations, it is necessary that the grout-supply hose extend to the bottom of the piling jacket when grout is first injected so that the grout must not fall a long distance to the bottom of the jacket. In this respect, if the grout were allowed to fall long distances, it would unduly disintegrate in the water before settling at the bottom of the jacket. As the jacket is filled the hose is pulled upwardly and finally out of the side port. Normally, sufficient grout must be injected into the jacket to fill the jacket above the port, up to the closed top of the jacket, before the hose is pulled out. Thus, when the grout-supply hose is pulled out of the side port, there is a pressure exerted to force the grout out the side port. A number of devices have been employed to prevent grout from passing out through the side port. One such device involves the use of an external flexible sleeve attached about the side port and extending upwardly therefrom. When the grout-supply hose is pulled out of the port, the external sleeve is held vertically above the jacket and grout is allowed to rise therein. The external sleeve is held in this vertical position until the grout hardens, thereby leaving a large vertical spike extending upwardly from a cast column. It is an object of this invention to provide a side port which does not create such an upwardly-extending spike or spur in a column cast with a jacket.

Other piling-jacket systems have used small nipples strategically located along the height of a piling jacket to which a supply hose is attached for injecting grout into the piling jacket at increasingly higher locations.

These nipples allow the grout to go in, but do not allow it to come out. Such nipples are shown in U.S. Pat. No. 3,397,260 to Lamberton. A difficulty with these nipples is that they make the injection of grout unduly slow in that they are usually small and in that the hose connection must be continually changed as the grout fills the jacket. They are generally inflexible in use and require much time and manpower.

It is an object of this invention to provide a piling-jacket system and method which allows a grout-supply hose to be inserted into a side port and the nozzle end thereof to be raised with the level of grout in the jacket by easily pulling the hose upwardly out of the side port as the level of grout is raised.

A problem which has been encountered in the use of some piling jacket systems in that hoses inserted in side ports thereof are sometimes difficult to pull out of the side ports after grout is inserted into the piling jacket because of pressure caused on the hose by the grout and closure systems at the ports for preventing outflow of grout once the hose is removed. In this regard, one system which has been used for preventing the outflow of grout uses a flexible flap valve attached to the interior surface of the piling jacket which, when the grout-supply hose is removed, is caused by grout flow to flop over the side port and thereby prevent further out flow of the grout. This side port arrangement is augmented by a perforated rigid tube located on the inside of the piling jacket extending the length of the jacket in which the grout-supply hose is inserted after it has been inserted through the side port for guiding the hose down into the jacket. Although this arrangement has the advantage of allowing the grout-supply hose to be easily moved into and out of the piling jacket, it also has the disadvantage of allowing grout to flow out of the piling jacket while the flap is seating and/or when it does not seat properly. Also, the elongated rigid tube which is left in the jacket becomes embedded in the grout once the grout hardens and thereby provides a weakened area of the grout. It is an object of this invention to provide a piling-jacket system which does not allow an undue flow of grout from a jacket when the supply hose is removed therefrom, but yet allows easy insertion and removal of the supply hose without leaving extraneous elements embedded in the grout.

It is a further object of this invention to provide a pile-jacket system having the atributes described above which is inexpensive to manufacture, but yet which is easy to use.

SUMMARY

According to principles of this invention, a pile-jacket side filling port includes a flexible flap valve which can be positively seated by a cord attached thereto extending externally of the piling jacket. In the preferred embodiment of the invention, the flap valve is in the form of an internal tubular duct having the cord attached to one side thereof and extending through a hole in the opposite side thereof.

The filling port itself is a vertical slit extending in the direction of the length of an elongated piling jacket so that the weight of the jacket and grout pulling down on the jacket tends to close the port. A portable rigid filling tube is inserted through the elongated-slit port to hold it open with a portion of the rigid filling tube extending into the interior of the jacket and another portion being held outside the piling jacket by a catch for preventing it from sliding through the port completely into the piling jacket.

The piling jacket includes a steel band at the top thereof for compressing the top of the piling jacket into a notch chisled in a piling being rehabilitated and can also include such a steel band at the bottom thereof.

BREIF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
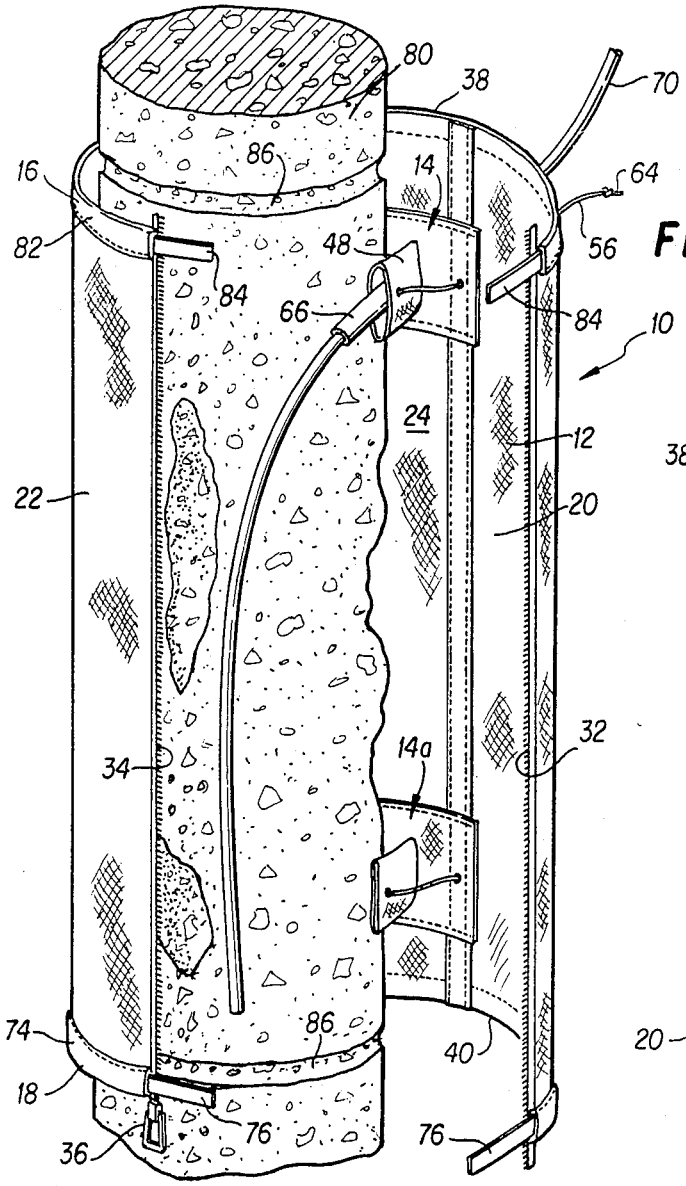
FIG. 1 is an isometric view of a piling jacket system of this invention shown partially wrapped about a piling to be repaired.

A piling jacket system 10 comprises an elongated piling jacket 12, top and bottom side filling port arrangements 14 and 14*a*, a top piling anchor arrangement 16 and a bottom piling anchor arrangement 18.

In the depicted embodiment the piling jacket 12 is constructed of three pieces of NYLON, BALLISTICS cloth. In this regard, a first side piece 20, a second side piece 22, and a center piece 24 are sewn together at doubled-over seams 26 and 28 (see FIG. 3) which are sewn along three stitch lines 30 in the manner shown in FIG. 3 with ¾ inch double-chain stitches. The piling jacket 12 has first and second longitudinal edges 32,34 along which opposite halves of a zipper are attached. When the longitudinal edges 32 and 34 are zipped together, the piling jacket 12 forms a cylinder having a diameter to allow at least a 4 inch minimum space between it and a piling on which it is to be mounted as will be described below. The length of the piling jacket depends on its application. It should be noted that the zipper halves at longitudinal edges 32 and 34 are extended at their ends about 2 inches beyond the main jacket body which makes initial engagement of the zipper halves easier and prevents the inadvertent unzipping thereof.

The bottom side filling port arrangement 14*a* is not normally needed for jackets that are less than 15 feet long, as will be further explained below.

Figure 2:
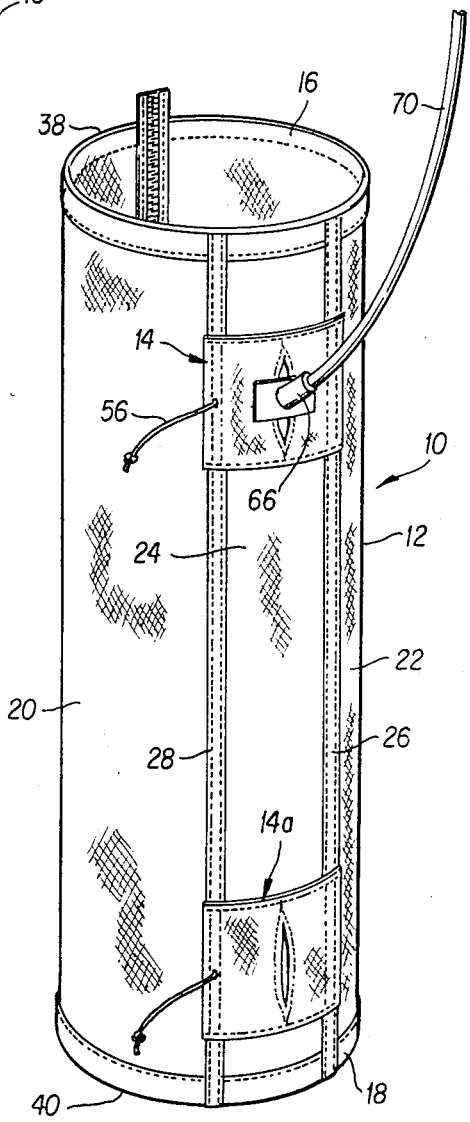
FIG. 2 is an isometric view of the piling jacket system of FIG. 1, without the piling, showing approximately the exterior opposite side from the side shown in FIG. 1.
Figure 3:
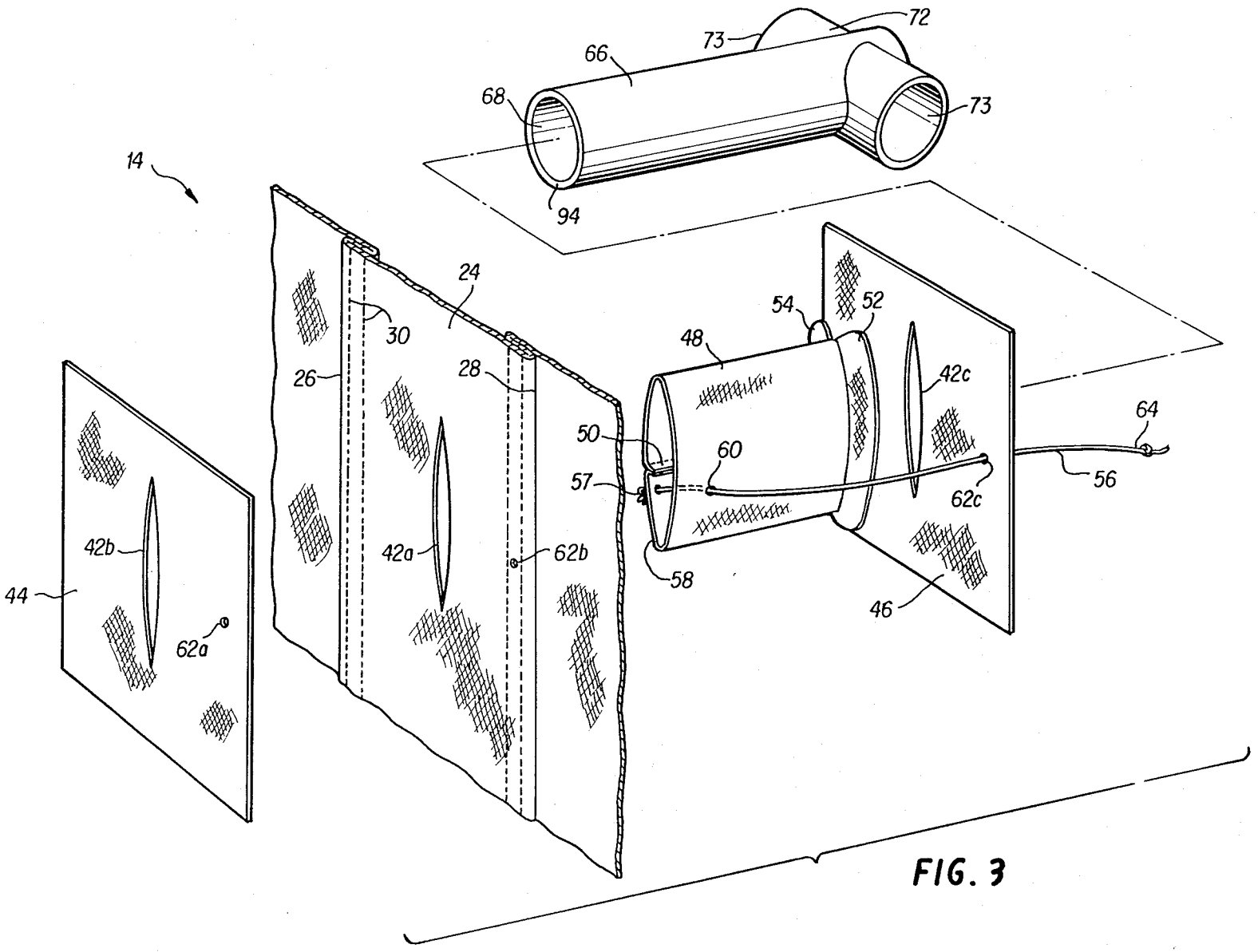
FIG. 3 is an isometric, enlarged, exploded, view of the side filling port arrangement of the piling-jacket system of FIGS. 1 and 2.

In the particular embodiment depicted side filling port arrangements 14 and 14*a* are mounted on the center piece 24 but extend across the reinforced seams 26,28 as is shown in FIGS. 1, 2 and 3. The top side filling port arrangement 14 is centered about 9½ inches from a top edge 38 of the piling jacket 12 and if length dictates the use of a bottom port the bottom side-filling port arrangement 14*a* is centered about 24 inches from a bottom edge 40 of the piling jacket 12.

Figure 4:
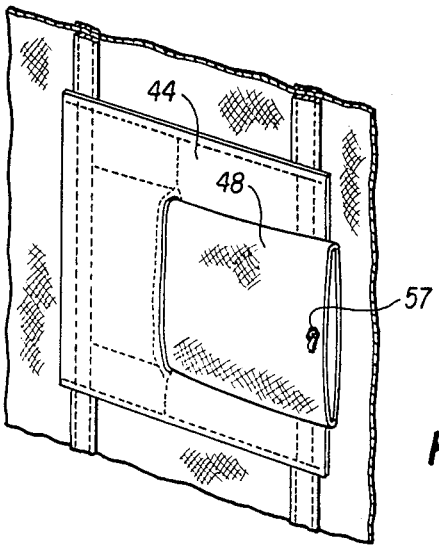
FIG. 4 is an isometric enlarged view of the side filling port arrangement as seen from the interior of the piling jacket when it is in a closed position.

The top and bottom side filling port arrangements 14, 14*a* are nearly identical and for this reason only the top side filling port arrangement 14 is described in detail with reference to FIG. 3, and the difference between it and the bottom side filling port arrangement will be pointed out. In this regard, a hot knife is used to cut 6½ inch slits 42*a*, 42*b*, and 42*c* in the NYLON BALLISTICS cloth of the respective centerpiece 24 and the 8½ in×11½ in. interior and exterior reinforcing pieces 44 and 46. An approximately 6 inch long tubularly-shaped duct 48, also constructed of NYLON BALLISTICS cloth, is sewn to have a tubular shape along a seam 50 and then is inverted to be as shown in FIG. 3. One end of the duct 48 is cut and arranged to form flanges 52 and 54 which are used for sewing the duct to the centerpiece 24 and the interior and exterior reinforcing pieces 44,46. When the duct 48 is flattened, it has a dimension of approximately 6½ inches wide so that it will easily pass from the exterior side of the piling jacket 12 through the slits 42*a* and 42*b* of the centerpiece 24 and the interior reinforcing piece 44. The exterior reinforcing piece 46 is placed on the exterior of the piling jacket 12 with its slit 42*c* aligned with the slits 42*a* and 42*b* of the centerpiece 24 and the interior reinforcing piece 44. All of these pieces are sewn together including the flanges 52 and 54 of the duct 48 along a number of reinforced seams. In this manner, great strength is provided to the side filling port arrangement 14 by the various reinforcing pieces 44,46, the seams 26 and 28, and the flanges 54. Once the duct 48 with the reinforcing pieces 44,46 are sewn in place, with the main body of the duct 48 extending through the middle piece and interior-reinforcing-piece slits 42*a*, 42*b*, and therefore being positioned on the interior of the piling jacket 12, a ⅛ inch polyester cord 56 is attached at 57 to one side of the duct 48, near an edge 58, and passed through hole 60, in the opposite side of the duct 48, and through holes 62*a*, 62*b*, 62*c* respectively in the interior reinforcing piece 44, the middle piece 24, and the exterior reinforced piece 46 until an outer end 64 thereof is exterior of the piling jacket 12. With this arrangement, when one pulls outwardly on the outer end 64 of the cord 56, the sides of the flexible duct 48 are flattened together against the interior reinforcing piece 44 in the manner shown in FIG. 4 to thereby prevent the passage of wet grout through the filling-port slits 42*a*,*b*,*c*.

The top filling port arrangement 14 also includes a rigid, portable access tube 66 which is constructed of hard PVC plastic or some other rigid material, although the rigid access tube 66 is not needed for the bottom filling port arrangement 14*a*. The access tube 66 has a bore 68 (FIG. 3) which is only slightly larger than the exterior surface of a grout-supply hose 70 (FIG. 5) so as to allow the grout-supply hose 70 to pass easily therethrough. The access tube 66 has an exterior catch 72 which contact the outside surface of the exterior reinforcing piece 46, adjacent the slit 42*c*, for preventing the access tube 66 from falling into the interior of the piling jacket 12. In the embodiment depicted in FIG. 3, the catch 72 is nothing other than a T-intersection of tubes with two spurs 73 extending laterally from a main access tube.

Figure 5:
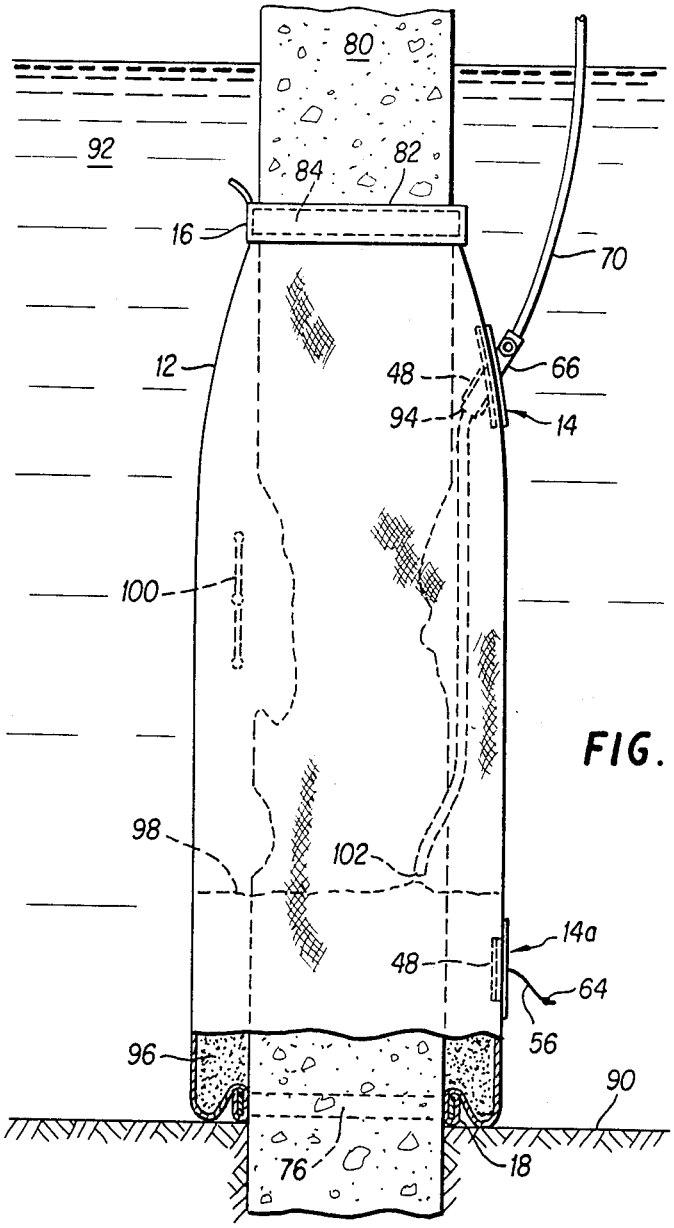
FIG. 5 is a partially-cutaway side view of the piling jacket system of FIGS. 1 and 2 shown mounted on a piling with many internal elements being shown in dashed lines.
Figure 6:
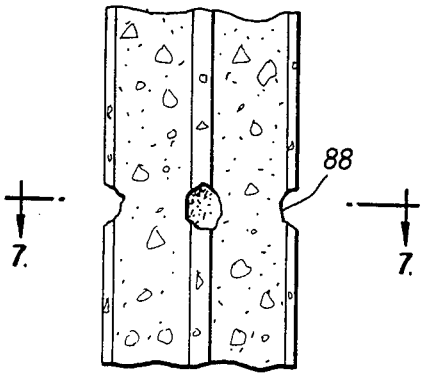
FIG. 6 is a side view of a rectangular piling on which the piling jacket of this invention can be often used; and, FIG. 7 is a cross-sectional view taken on line 7—7 of FIG. 6.

The bottom piling-anchor arrangement 18 includes a doubled-over seam at the bottom edge 40 of the piling jacket 12 for forming a sleeve 74 and a steel band 76 passing through the sleeve 74 with opposite ends extending out thereof. The opposite ends of the steel band 76 can be pulled tight in the sleeve 74 for crimping the bottom edge 40 of the piling jacket 12 against a piling 80 as is shown in FIG. 5. The steel band 76 could be replaced by a flexible cord for short jackets, however, for sake of standardization steel bands are normally used.

Figure 7:
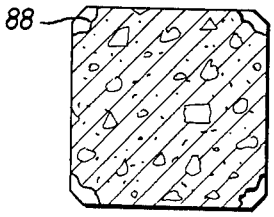

The top piling-anchor arrangement 16 also comprises a doubled-over sleeve 82 (FIG. 1) formed at the top edge 38 of the piling jacket 12 which contains a steel band 84. The sleeve 82 is also pulled tight by the steel band 84 to clamp the top edge 38 of the piling jacket 12 on the piling 80. With regard to pulling the steel bands 76 and 84 tight, before this done, grooves 86, or corner notches 88 (as is depicted in FIGS. 7 and 8 for rectangular pilings), are chisled in the piling. It is into these grooves 86, or corner notches 88, that the steel bands 76 and 84 clamp the top and bottom edges 38 and 40 of the piling jacket 12 for positively holding the piling jacket along the piling 80.

Describing now operation and use of the piling-jack system 10 of this invention, the piling jacket 12 is wrapped about a piling 80 in the manner shown in FIG. 1 so that it completely encloses the piling 80, as well as metal reinforcing 100 if desired, and so that the zipper slider 36 can be used to zip up the longitudinal edges 32 and 34. Grooves 86, if the piling is round, or corner notches 88, if the piling is rectangular, are chisled in the piling at the levels at which the piling's top and bottom edges 38 and 40 are to be supported along the piling 80 and outer ends of the steel bands 76 and 84 are pulled tightly to contract the steel bands 76 and 84 and the top and bottom edges 38 and 40 into these grooves 86 or these notches 88.

The depicted piling jacket 12 is longer than 15 feet and therefore initial use of the bottom side filling port arrangement 14*a* is preferred. It is not necessary to use the rigid access tube 66 with the bottom side filling port arrangement 14*a* because the head of grout which will be introduced therethrough will not develop enough pull on the jacket 12 that the closing of slits 42*a–c* on the hose 70 will be a problem. Also, the hose 70 will not be extended very far into the jacket 12 so it will not have much "drag" caused by friction between it and reinforcing and the jacket wall. Thus, a grout-supply hose 70 is inserted through the bottom side filling port arrangement 14*a* and wet grout is pumped through the grout-supply hose 70 to fill the piling jacket 12 approximately to a predetermined level 98 shown in FIG. 5 for creating a bottom seal of grout. Thereafter, the grout-supply hose 70 is pulled out of the filling-port slits 42, the outer end 64 of the cord 56 is immediately pulled outwardly to close the duct 48 and thereby prevents retro-movement of the wet grout 96 through the slots 42 of the bottom filling port arrangement 14*a*. At this point the wet grout 96 tends to expand laterally in the piling jacket 12 and apply downward pressure on the walls thereof, pulling them tautly from the top piling anchor arrangement 16. This wet grout is allowed to cure to a certain degree, which will prevent slippage of the bottom steel band 76 and leakage of grout around this banding during later pouring operations, when great pressures will be created. This initial pouring also maintains the wall of the piling jacket 12 relatively taut against the band 84 during the pouring of the remainder of the grout. Thus, when further wet grout is introduced into the upper side filling port arrangmement 14 the jacket does not bulge as much and tends to produce a column having a more uniform-dimensioned outer surface than is otherwise possible.

Once this first wet grout 96 has cured to a desired degree, the access tube 66 is inserted through the slits 42*a, b,* and *c* of the upper top port arrangement 14 and the grout-supply hose 70 is inserted therethrough as is shown in FIG. 5. The end of the wet grout-supply hose 70 is extended to the top level 98 of the previously introduced grout and additional grout is pumped in. As the level of the grout rises, the grout-supply hose is raised therewith, its mouth 102 remaining slightly immersed in the puddle of rising grout. In this regard, downward pull on the jacket 12 increases tremendously as this grout is introduced due to the increasing weight of the grout head in the jacket. Similarly, friction on the hose 70 in the jacket caused by the grout, reinforcing 100 and the jacket increases with the increase in grout head, but the rigid access tube 66 still allows the hose to be easily pulled out of the slits 42*a–c*. When the wet grout reaches the lower end 94 of the access tube 66, the access tube 66 is pulled out of the slits 42*a–c* of the top filling port arrangement 14 and the hose 70, by itself is inserted therein. Additional wet grout is injected through the hose to raise the level thereof to the seal at the upper steel band 84. During this stage of the procedure the slits 42*a–c* of the top filling port arrangement 14 are urged to close by the tremendous weight pulling downwardly on the jacket 12 and this does produce a "drag" on movement of the hose 70 into and out of the slits 42*a–c*, however, this "drag" is now manageable because so little of the hose is in the jacket to come into contact with reinforcing, jacket walls, and grout and thereby produce undue friction. At this point, the grout-supply hose 70 is pulled out of the duct 48 and the slits 42*a, b, c*. The outer end 64 of the cord 56 is immediately pulled to flatten the duct 48 and thereby close off the slits 42*a,b,c* to the outflow of wet grout.

It can be appreciated by those skilled in the art that the piling-jacket system of this invention allows easy insertion and removal of the grout-supply hose 70 from the piling jacket 12 while not allowing an undue amount of wet grout to flow out of the piling jacket. In this regard, it will be understood that when the wet grout rises above the duct 48, pressure therefrom causes the duct to press around the outer surface of the hose 70 so that grout cannot flow between the duct 48 and the hose 70.

Further, externally-forced closing of the duct 48 by means of the pull cord 56 produces a quick and positive closing thereof so that the duct cannot become wedged in an open position.

Another very beneficial aspect of this invention is that the vertically oriented slits 42*a,b,c* tend to automatically close in response to longitudinal tension on the piling jacket 12 caused by the weight of the piling jacket itself and of the grout introduced in the piling jacket as is depicted in FIG. 5. This automatic closing of these slits is highly beneficial for preventing the outflow of wet grout when the access tube 66 and/or the hose 70 are removed. However, the access tube 66 prevents this automatic closing from clamping on the grout-supply hose 70 when the supply hose is extended far into the jacket 12 to hinder movement the supply hose into and out of the piling jacket through the slit 42*a,b,c.*

The lower and upper steel bands 76 and 84 contracting into the chisled grooves 86, or corner notches 88, provide a positive holding of the top and bottom edges of the piling jacket 12 relative to the piling 80, but yet, are uncomplicated to install and mount.

With regard to the vertical slits, most prior-art piling jackets have side filling ports with horizontal slits or round holes, most likely to avoid automatic closing thereby making insertion and removal of a grout-supply hose easier. In this regard, the horizontal slits or round holes have a tendency to be pulled open wider as downward jacket tension increases.

Since the grout supply hose is easy to maneuver in the access tube of this invention, the grout supply hose can be more easily threaded down into the jacket.

While the invention has been particularly shown and described with reference to a preferred embodiment, it will be understood by those skilled in the art that various changes in form and detail may be made therein without departing from the spirit and scope of the invention. For example, it would be possible to use a single flexible flap rather than a duct 48 which is attached to a cord to be positively closed on the slits 42*a,b,c,* however, this closing would probably not be quite as reliable as the duct. Further, it is not necessary to have top and bottom filling port arrangements 14 and 14*a.* Also, rather than using a T-shaped rigid access tube 66, the catches 72 could be an integral hook, a separate clip, or the like. Still further, there are materials other than NYLON BALLISTICS cloth available which could be used for making the various parts of the piling jacket system. Also, the seams 26 and 28 on the piling jacket 12 are not essential to the invention and if such seams are used, it is not essential that they be spanned by the interior and exterior reinforcing pieces 44 and 46 as in the depicted embodiment. In this regard, the embodiment depicted herein was made as shown because of the width of BALLISTICS-cloth bolts from which it was made and because of the jacket's particular size. It should be understood that the jacket 12 can be of various sizes depending on the size of a piling with which it is to be used. Normally there is approximately a 4 inch gap between the piling jacket and the piling. One tries to use the full width of a cloth bolt in making the jacket and therefore the seam location is somewhat arbitrary.

The embodiments of the invention in which an exclusive propertly or privilege are claimed are defined as follows:

1. A piling-jacket system including an elongated, hollow, piling jacket of flexible material having a top end and a bottom end for receiving grout therein and retaining said grout during the curing thereof for forming a concrete column therewith, said piling-jacket system comprising:

a filling-port means located on the side of said piling jacket intermediate said top and bottom ends thereof, said filling-port means including an open port in said flexible-material jacket, a flap of flexible material mounted adjacent said open port on an interior surface of said piling jacket, and a flexible flap cord attached to said flap at an outer end portion thereof and extending through a cord hole defined by said flexible piling jacket to the exterior thereof;

whereby a concrete-supply hose can be inserted through said open port thereby holding said flap away from said open port through which wet concrete can be pumped into the interior of said piling jacket and thereafter, once a top surface of said wet concrete is above said open port, said flexible concrete-supply hose can be pulled out of said open port so as to allow said flap to close said open port, and said flap cord can be pulled outwardly to positively pull said flap over said open port and thereby preventing wet concrete on the interior of said piling jacket from passing through said open port to the exterior thereof.

2. A piling-jacket system as in claim 1, wherein said flexible flap is a tubularly shaped duct attached about the perimeter of said open port through which wet grout passing through said open port passes to enter said piling jacket.

3. A piling-jacket system as in claim 2, wherein said open port is a slit in the side of said piling jacket parallel with the elongation of said piling jacket.

4. A piling-jacket system as in claim 3, wherein is further included a metallic band at each of top and bottom ends of said piling jacket for crimping said piling jacket on a piling.

5. A piling-jacket system as in claim 3, wherein is further included a rigid, portable, access tube for insertion through said open port for holding said open port and said flexible flap open to allow the insertion of wet grout into said piling jacket through said open port.

6. A piling-jacket system as in claim 2, wherein is further included a rigid, portable, access tube for insertion through said open port for holding said open port and said flexible flap open to allow the insertion of wet grout into said piling jacket through said open port.

7. A piling-jacket system as in claim 1, wherein is further included a rigid, portable, access tube for insertion through said open port for holding said open port and said flexible flap open to allow the insertion of wet grout into said piling jacket through said open port.

8. A piling-jacket system as in claim 1, wherein is further included a metallic band at each of top and bottom ends of said piling jacket for crimping said piling jacket to a piling.

9. A piling-jacket system including an elongated, hollow, piling jacket of flexible material having a top end and a bottom end for receiving grout therein and for retaining said grout during the curing thereof for forming an elongated vertically-oriented, column therewith, said piling-jacket system comprising:

a filling-port means located on the side of said piling jacket intermediate said top and bottom ends, said filling-port measn including an open port in said flexible-material jacket but including a closing means for closing said open port to prevent flow of wet grout from said port;

a separate, rigid, portable, access tube having open first and second ends for insertion of said first end through said open port to disable said closing means and thereby hold said open port fully open and for allowing the insertion therethrough, from said second end, of a flexible supply hose which injects wet grout into said piling jacket, said access tube having a catch thereon for contacting said piling jacket to prevent it from falling through said open port into said piling jacket;

whereby said flexible-supply hose can be inserted through said access tube through which wet concrete can be injected into the interior of said piling jacket and thereafter, once a top surface of said wet concrete is above said open port, said flexible concrete-supply hose and said access tube can be pulled out of said open port so as to allow operation of said closing means to close said open port, thereby preventing wet concrete on the interior of said piling jacket from passing through said open port to the exterior thereof.

10. A piling jacket system as in claim 9, wherein said open port is a slit in the side of said piling jacket parallel with the elongation of said piling jacket.

11. A piling-jacket system as in claim 10, wherein is further included a metallic band at each of top and bottom edges of said piling jacket for crimping said piling jacket on a piling.

12. A piling-jacket system as in claim 9, wherein is further included a metallic band at each of top and bottom edges of said piling jacket for crimping said piling jacket on a piling.

13. A method of preparing damaged pilings comprising the steps of:

wrapping an elongated tubularly shaped jacket about said piling, said tubularly-shaped jacket having a size so that there is a space left between the tubulary-shaped jacket and said piling, said tubulary-shaped jacket including an automatically-closing port in the side thereof through which wet grout can be injected into said piling jacket;

attaching the upper edge of said piling jacket to said piling to thereby firmly mount said upper edge of said piling jacket on said piling;

attaching the bottom edge of said piling jacket to said piling to mount said bottom edge on said piling;

inserting a rigid portable tube having a catch thereon through said automatically-closing port from the exterior of said jacket to the interior thereof, and allowing said catch to hold said rigid acess tube in said port, thereby holding said port open for receiving wet grout;

inserting a grout-supply hose through a bore of said access tube from the exterior of said piling jacket to the interior of said piling jacket and pumping wet grout through said supply hose into said piling jacket; and, upon the level of said wet grout reaching a desired level, removing said grout supply hose and said access tube from said automatically-closing port, thereby allowing said automatically-closing port to close.

14. A method as in claim 13, wherein said automatically-closing port in said piling jacket is created by the step of slitting said piling jacket along the length thereof.

15. A method as in claim 13, wherein is further included the step of fastening a flap on the interior of said piling jacket at said automatically-closing port and attaching a cord to said flap which extends through a hole in said piling jacket to the exterior of said piling jacket and wherein is further included the step of causing said flap to close over said port by pulling said cord outwardly.

16. A method as in claim 15, wherein is further included the step of making said flap to be in the shape of a flexible tubular duct.

17. A method as in claim 15, wherein said step of attaching said upper edge of said piling jacket to said piling is accomplished by means of a metallic band which is contracted onto said piling and wherein is included the step of chisling notches in said piling into which said metallic band is contracted.

18. A method as in claim 13, wherein said step of attaching said top end of said piling jacket to said piling is accomplished by means of an endless metallic band which is contracted onto said piling and wherein is included the step of chisling notches in said piling into which said metallic band is contracted.

19. A method as in claim 18, wherein said open port in said piling jacket is created by the step of slitting said piling jacket along the length thereof.

* * * * *